US008076600B2

(12) United States Patent
Bura et al.

(10) Patent No.: US 8,076,600 B2
(45) Date of Patent: Dec. 13, 2011

(54) CONTACT ACTUATING MECHANISM FOR SWITCHING DEVICE

(75) Inventors: Virendra Singh Bura, Maharashra (IN); Satbir Singh, Maharashra (IN)

(73) Assignee: Larsen & Toubro Limited, Mumbai (IN)

( * ) Notice: Subject to any disclaimer, the term of this patent is extended or adjusted under 35 U.S.C. 154(b) by 356 days.

(21) Appl. No.: 12/344,862

(22) Filed: Dec. 29, 2008

(65) Prior Publication Data

US 2009/0166162 A1 Jul. 2, 2009

(30) Foreign Application Priority Data

Dec. 27, 2007 (IN) ..... 2579/MUM/2007

(51) Int. Cl.
*H01H 3/04* (2006.01)

(52) U.S. Cl. ..... 200/335

(58) Field of Classification Search ..... 200/335, 200/400

See application file for complete search history.

(56) References Cited

U.S. PATENT DOCUMENTS

| | | | | |
|---|---|---|---|---|
| 3,671,687 | A * | 6/1972 | Bleibtreu et al. | 200/11 TC |
| RE33,400 | E * | 10/1990 | Fujii et al. | 335/26 |
| 5,660,271 | A * | 8/1997 | Castonguay et al. | 200/401 |
| 6,225,883 | B1 * | 5/2001 | Wellner et al. | 335/172 |
| 6,706,987 | B1 * | 3/2004 | Yoo | 200/529 |
| 6,747,532 | B1 * | 6/2004 | Tobin et al. | 335/6 |
| 7,009,129 | B2 * | 3/2006 | Vierling | 200/400 |
| 7,102,088 | B2 * | 9/2006 | Tan et al. | 200/6 A |
| 7,800,007 | B2 * | 9/2010 | Soundararajan et al. | 200/400 |

* cited by examiner

*Primary Examiner* — Vanessa Girardi
(74) *Attorney, Agent, or Firm* — Merchant & Gould P.C.

(57) ABSTRACT

According to one embodiment of the present invention, a contact actuating mechanism is provided with a rotary contact to make and break electrical contacts. An operating knob is connected an operating lever and to a connecting link through a U-shaped pin. The operating lever is engaged with a lock lever. The connecting link is also coupled to the rotary contact through a pivot so that the operating knob is moved to displace the connecting link to move the rotary contact to make and break with electrical contacts.

7 Claims, 5 Drawing Sheets

CONTACT ACTUATING MECHANISM FOR SWITCHING DEVICE

BACKGROUND

1. Technical Field

The embodiments herein generally relate to an electrical power supply device and particularly to controllers used for domestic and industrial purposes. The embodiments herein more specifically relate to the switching devices such as miniature circuit breaker, residual current circuit breaker, isolator and their auxiliary contacts, etc.

2. Description of the Related Art

Electrical switching devices are used to protect the electrical circuitry and equipment from the damage due to an abnormal condition, such as an overload condition, a relatively high level short circuit or a fault condition. The electrical switching devices typically have two operating handle positions corresponding to the status of the separable contacts. For example, these positions include an ON position, in which the separable contacts are closed and an OFF position in which the contacts are open. Some switching devices have a third position which corresponds to a tripped condition in which the contacts are tripped open.

Switching devices are usually installed in an enclosure so that the entire control and distribution network arranged in the form of metallic sheets and/or cable wires are housed inside the enclosure. All the operating means are arranged outside the enclosure to prevent an access to the high voltage sections to eliminate the generation of a potential hazard. It is often desirable or essential that the settings of the switching devices remain undisturbed in the switching device during a maintenance operation. Unauthorized or inadvertent changing of the position of these breakers could result in unwanted interruptions to service or operations and serious damage to an electrical apparatus, or even serious harm to a person. For example, accidental actuation of a circuit breaker might result in electrocution or shock to a workman performing electrical work or repair on equipment downstream from the circuit breaker.

Therefore enough safety measures must be taken to prevent another person from inadvertently returning the circuit breaker handle to the ON position, when a worker is doing electrical work in an area other than the immediate vicinity of the circuit breaker box or electrical panel. One such safety measure is the addition of a locking assembly to the switching device to prevent the displacement of the circuit breaker operating handle.

A circuit breaker is an automatically-operated electrical switch designed to protect an electrical circuit from damage caused by overload or short circuit. Unlike a fuse, which operates once and then has to be replaced, a circuit breaker can be reset (either manually or automatically) to resume normal operation. Circuit breakers are made in varying sizes, from small devices that protect an individual household appliance up to large switchgear designed to protect high voltage circuits feeding an entire city. The Circuit breakers for larger currents are usually arranged with pilot devices to sense a fault current and to operate the trip opening mechanism.

There are different technologies used in circuit breakers and they do not always fall into distinct categories. The commonly used circuit breakers in domestic, commercial and light industrial applications at low voltages (less than 1000 V) include a Miniature Circuit Breaker (MCB) and a Moulded Case Circuit Breaker (MCCB).

The MCB is used for a rated current of not more than 100 A. the trip characteristics are not adjustable normally. The MCB employs thermal or thermo-magnetic principles. The MCCB is used for a rated current up to 1000 A. The MCCB uses the thermal or thermal-magnetic operation. The trip current may be adjusted in the MCCB.

In any kind of circuit breaker or switching device the operating mechanism plays a main role. Since the module width of the low voltage circuit breaker is very less (17.5 mm), the operating mechanism should be compact. Moreover, since a rotary contact is used in the circuit breakers, some special mechanism needs to be devised to make and break the contacts quickly and safely.

The currently available circuit breaker utilizes several linkages to operate a trip mechanism to make and break the electrical contacts. The circuit breakers used in low voltage applications are mostly used for domestic purposes. None of the currently available circuit breaker or switching device has a compact operating mechanism and has less operating time to make and break the electrical contacts quickly and safely. Hence there is a space constraint and a compelling need for the space saving type circuit breaker.

SUMMARY

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concept of the invention in a simplified form as a prelude to the more detailed description that is presented later.

The embodiments provide a compact fast break—type contact arrangement in a switching device to make and break the electrical contacts quickly and safely. According to one embodiment, a switching device is provided with compact fast actuating type contacts so that the breaking of contacts takes place very quickly. A compact switching mechanism is provided with a rotary contact to make and break electrical contacts quickly and safely.

According to one embodiment, the circuit breaker assembly has a knob connected to a connecting link and to a first operating lever through a U-shaped pin. One end of the connecting link is coupled to the knob while the other end of the connecting link is connected to a rotary contact through a pivot so that the movement of the connecting link is transferred to the rotary contact. The movement of the connecting link is used to make and break the electrical contacts. The other end of the first operating lever connected to the knob is engaged to a locking lever. When the locking lever is moved on its own axis, the first lever is released from the locking lever to trip a contact breaker mechanism. When the first lever is locked with the locking lever, the connecting link is moved due to the movement of the knob to rotate the rotary contact to make or break the electrical contacts.

The breaker mechanism has a unique design and a compact structure so that the mechanism may be used effectively and efficiently in a half module with a width of 9 mm. The operating time is greatly reduced due to the usage of fewer link mechanisms. The operating Knob is moved to OFF position, even when the moving contact is held forcibly by just rotating locking lever.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

Although specific features of the present invention are shown in some drawings and not in others. This is done for convenience only as each feature may be combined with any or all of the other features in accordance with the present invention.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The present invention provides a compact fast break—type contact arrangement in a switching device to make and break the electrical contacts quickly and safely. According to one embodiment of the present invention, a switching device is provided with a switching mechanism having a rotary contact to make and break the electrical contacts quickly, easily, efficiently and safely.

According to one embodiment of the present invention, the circuit breaker assembly has a knob connected to a connecting link and to a first operating lever through a U-shaped pin. One end of the connecting link is coupled to the knob while the other end of the connecting link is connected to a rotary contact through a pivot so that the movement of the connecting link is transferred to the rotary contact. The movement of the connecting link is used to make and break the electrical contacts. One end of the first operating lever is connected to the knob while the other end of the operating lever is engaged to a locking lever. When the locking lever is moved on its own axis, the first operating lever is released from the locking lever to trip a contact breaker mechanism. When the first lever is locked with the locking lever, the connecting link is moved due to the movement of the knob to rotate the rotary contact to make or break the electrical contacts.

According to one embodiment of the present invention, the breaker mechanism has a unique design and a compact structure so that the mechanism may be used effectively and efficiently in a half module with a width of 9 mm. The operating time is greatly reduced due to the usage of fewer link mechanisms. The operating Knob is moved to OFF position, even when the moving contact is held forcibly by just rotating locking lever.

Figure 1:
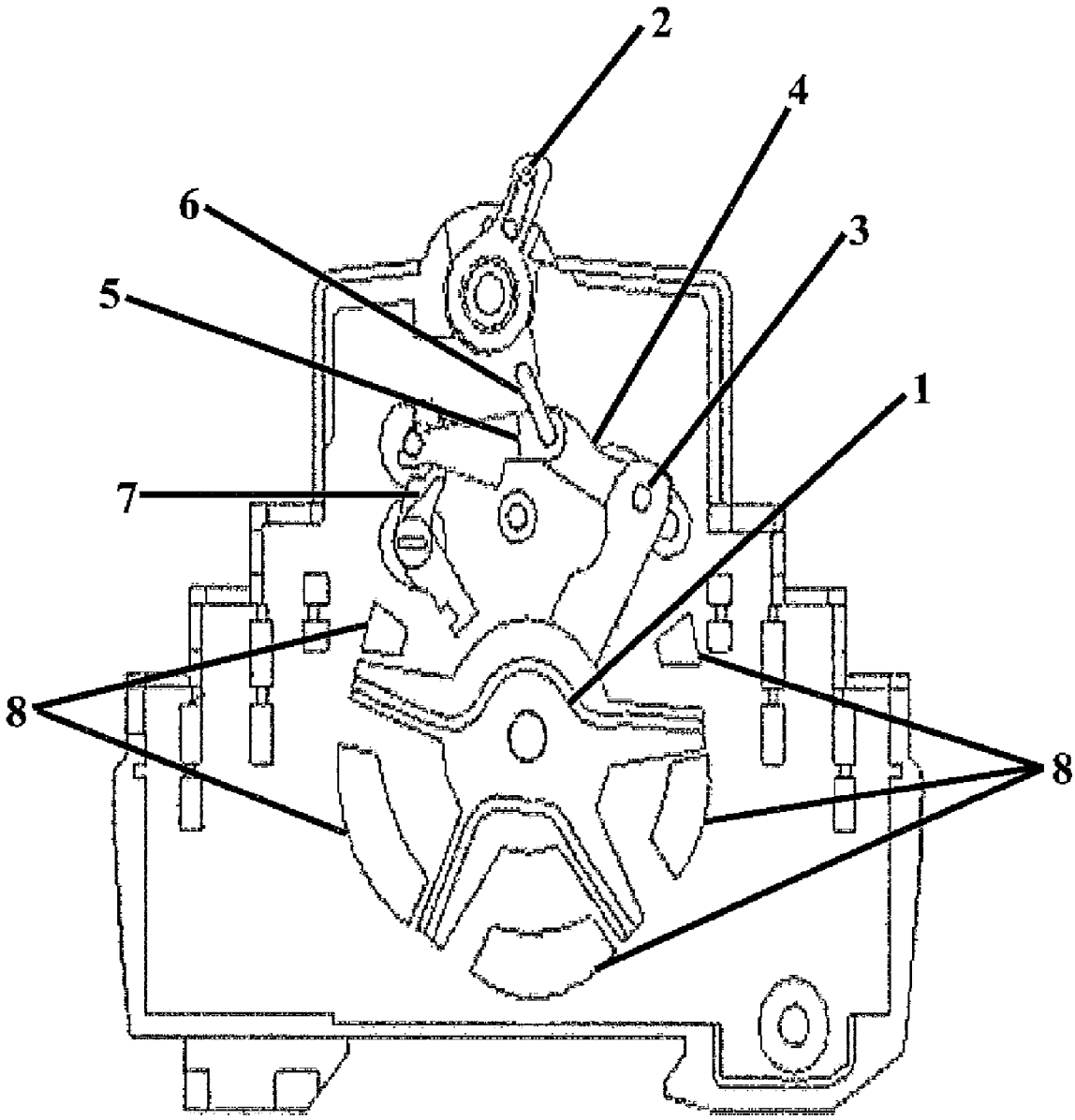
FIG. 1 illustrates a side sectional view of a switching device according to one embodiment of the present invention with the switch held in ON position to establish electrical contacts at four locations.

FIG. 1 shows a side sectional view of a switching device according to one embodiment of the present invention with the switch being held in the ON position.

Figure 2:
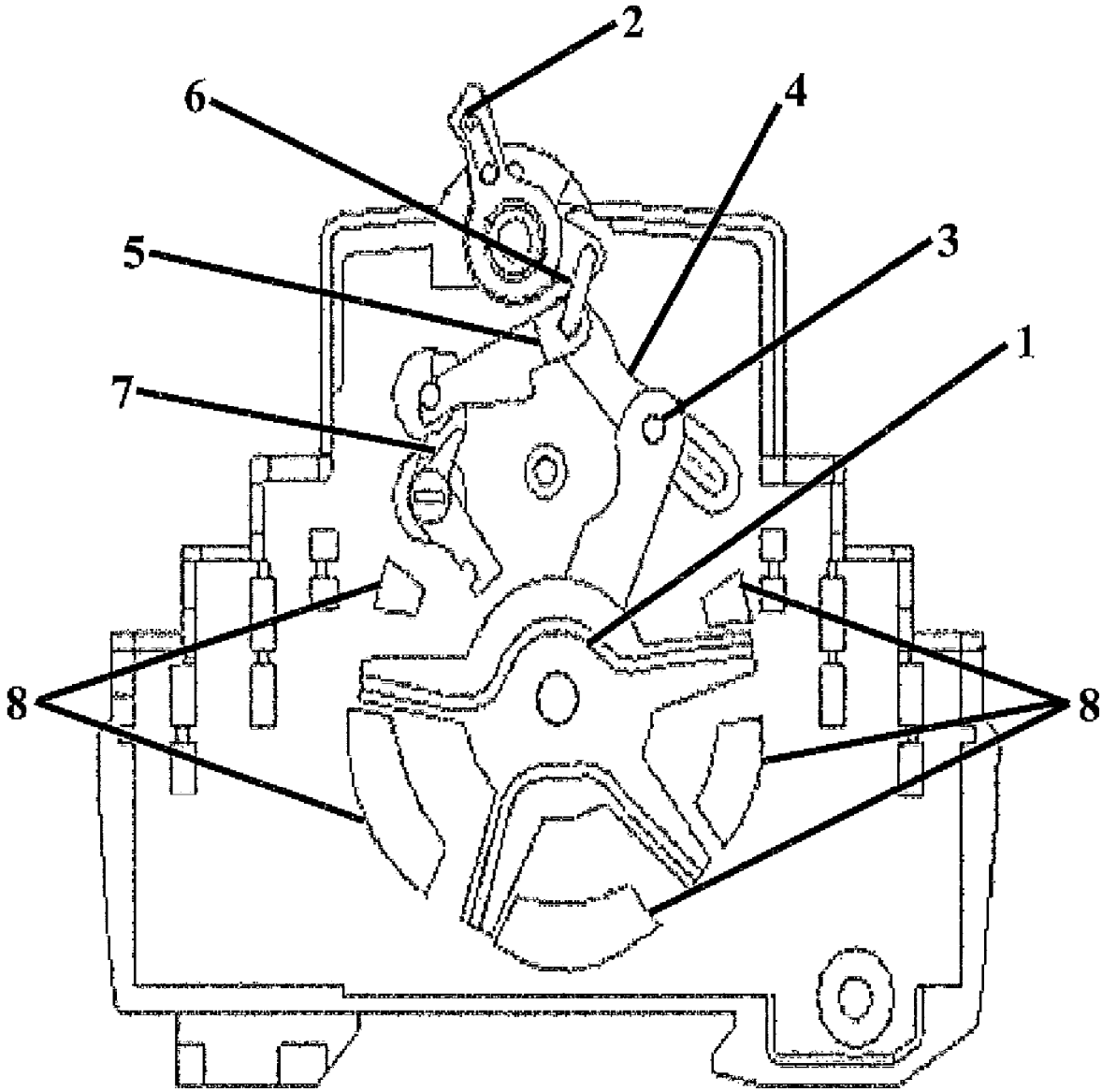
FIG. 2 illustrates a side sectional view of a switching device with the switch held in OFF position to break the electrical contacts at four locations.

FIG. 2 shows a side sectional view of the switching device according to one embodiment of the present invention with the switch being held in the OFF position.

Figure 3:
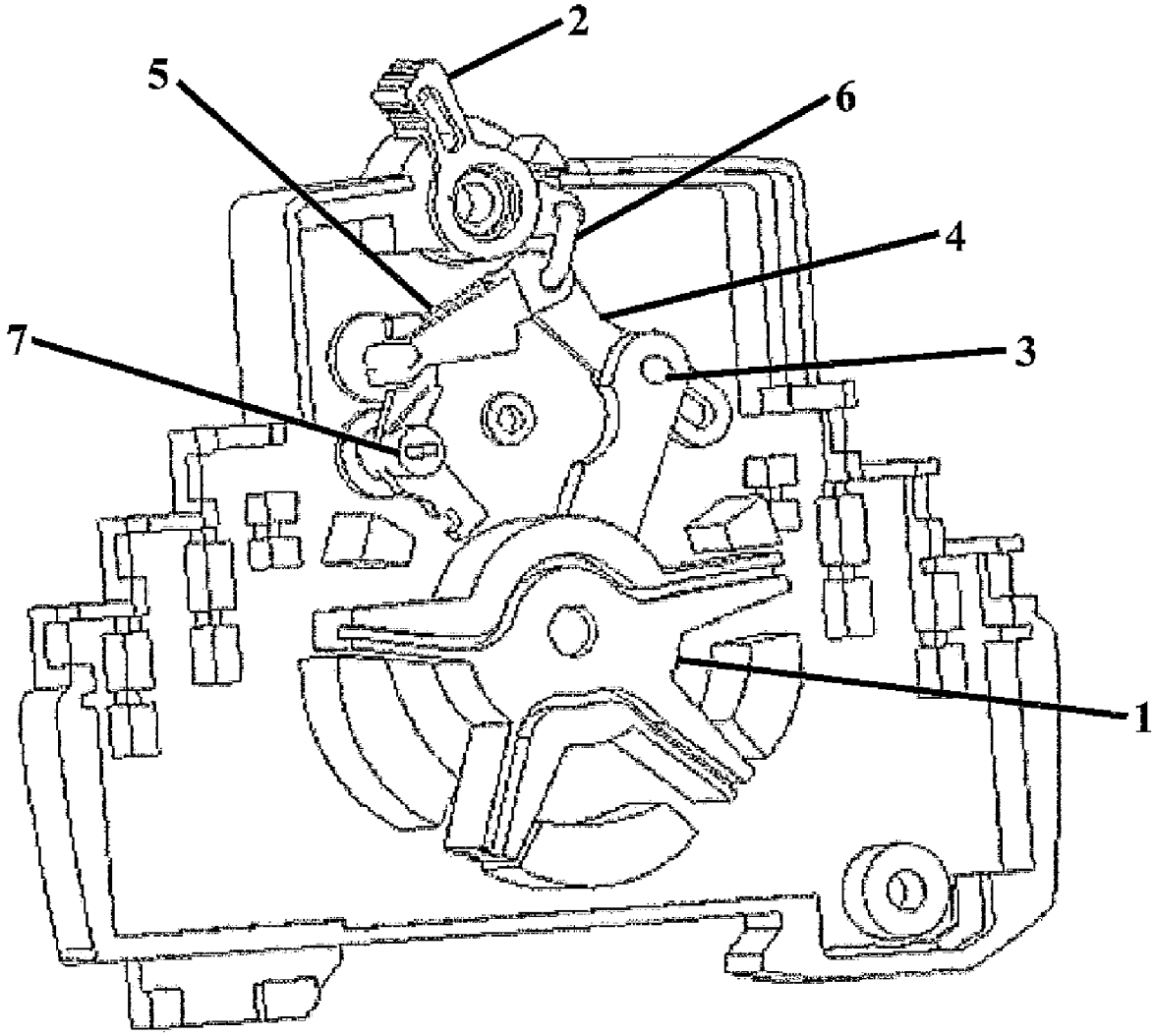
FIG. 3 illustrates a side sectional view of a switching device according to one embodiment of the present invention.

FIG. 3 illustrates a sectional view of the switching device according to one embodiment of the present invention.

Figure 4:
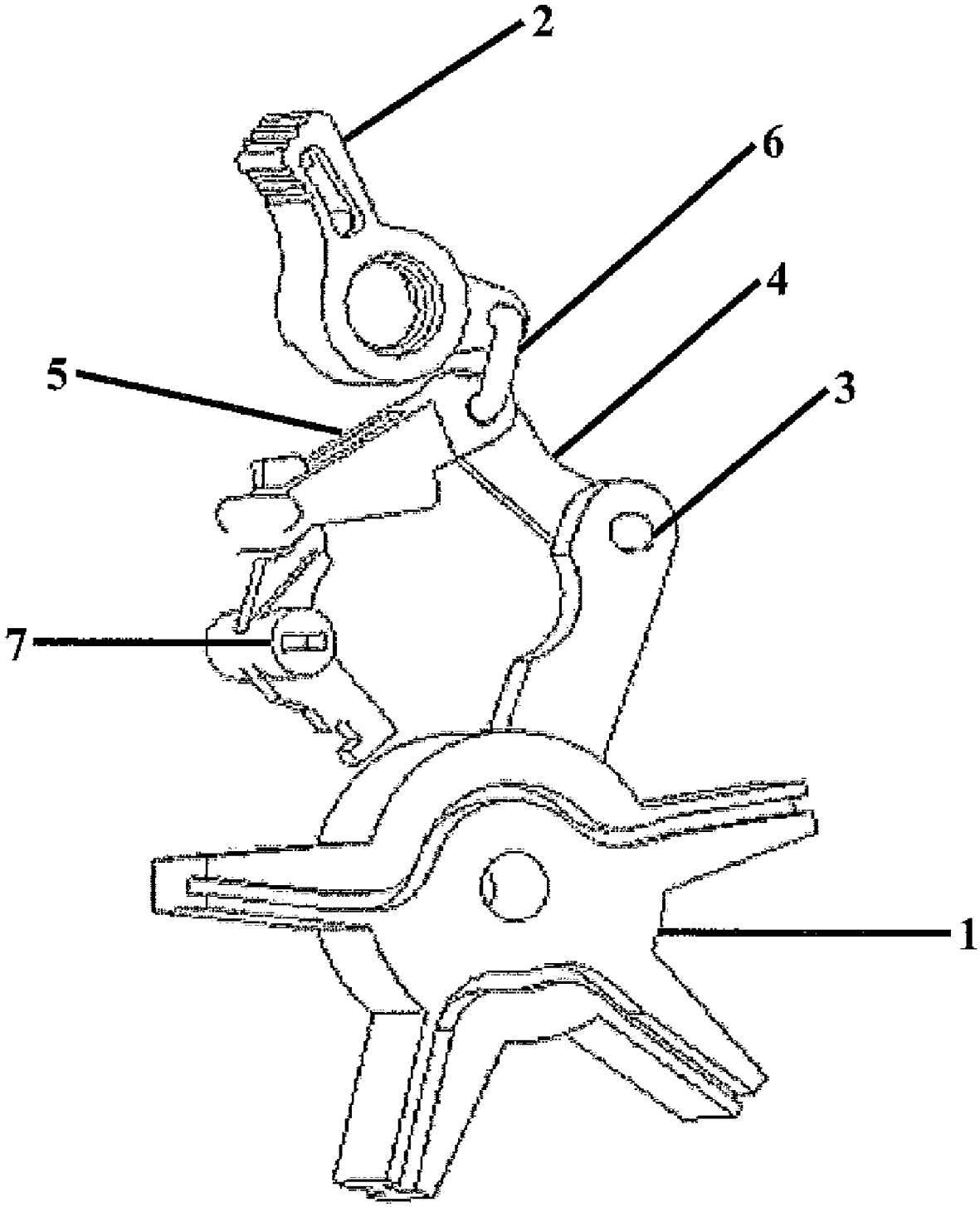
FIG. 4 illustrates a side sectional view of an electrical contact switching mechanism in an assembled condition in a switching device.
Figure 5:
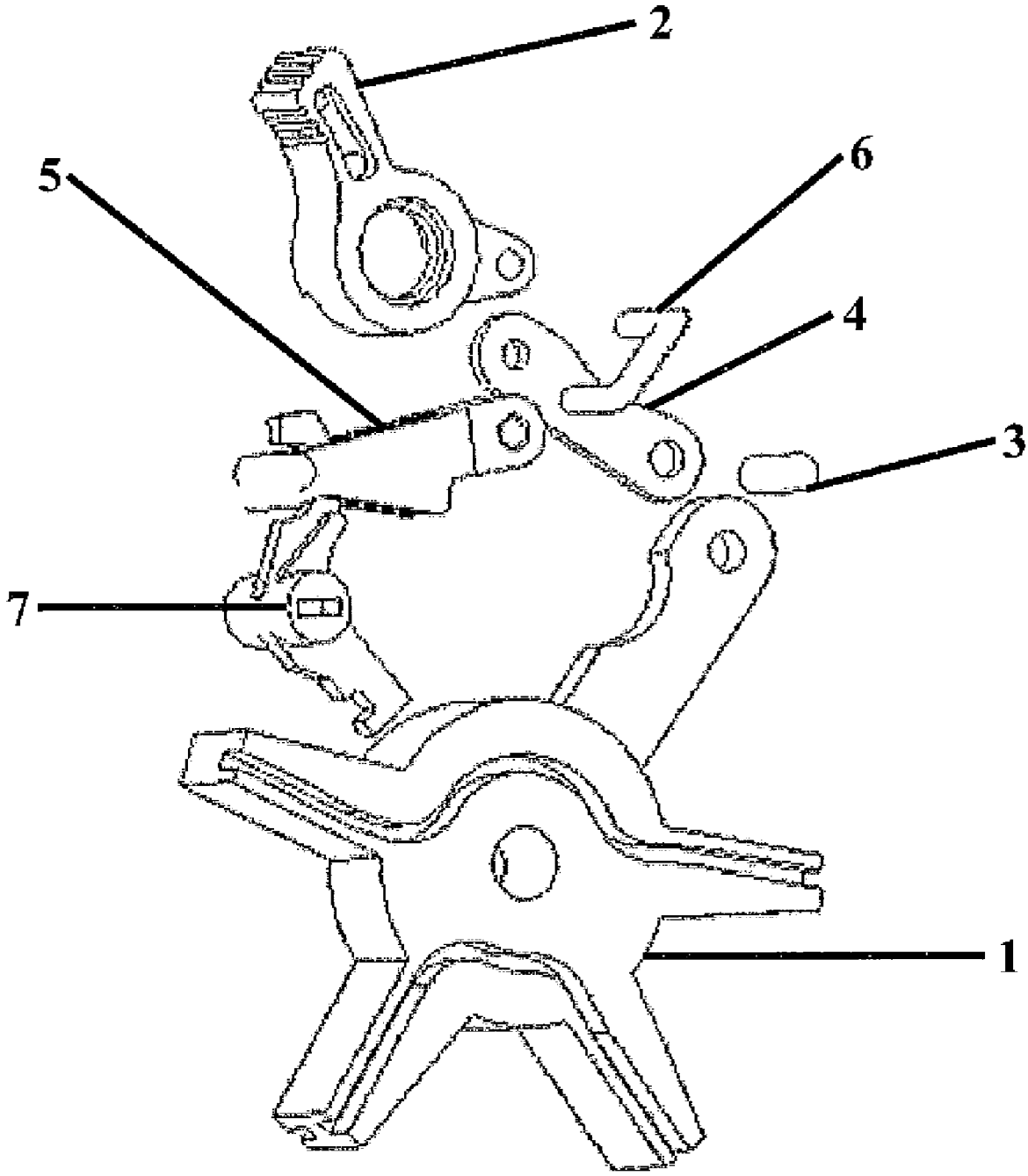
FIG. 5 illustrates a side sectional view of an electrical contact switching mechanism in an unassembled condition in a switching device according to one embodiment of the present invention.

With respect to the FIGS. 1, 2 and 3, operating knob 2 is connected to a U-pin 6. U-Pin 6 is further connected to operating lever 5 and to connecting link 4. One end of connecting link 4 is coupled to knob 2 through U-pin 6, while the other end of connecting link 4 is attached to rotary contact 1 through pivot 3. The movement of connecting link 4 is transferred to rotary contact 1 with the help of pivot 3 so that connecting link 4 is moved by operating knob 2 to rotate rotary contact 1 to make and break electrical contacts 8. One end of operating lever 5 is coupled to knob 2 through U-pin 6, while the other end of operating lever 5 is engaged to locking lever 7. FIGS. 4 and 5 indicate the side sectional view of a switching mechanism in an assembled and in an unassembled condition respectively in a switching device according to one embodiment of the present invention. Operating Knob 2 is connected to connecting link 4 and to operating lever 5 through U-pin 6. The other end of the operating lever 5 is locked with locking lever 7. When locking lever 7 is moved about its own axis, operating lever 5 is released from the locking condition to trip the contact switching mechanism. The other end of connecting link 4 is connected to the rotary contact 1 through pivot 3. When operating lever 5 is locked, knob 2 is operated to move connecting link 4 to rotate rotary contact 1 to make or break the electrical contacts.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. An electrical contact actuating mechanism for switching device comprising:

an operating knob;

an operating lever connected to the operating knob through a pin;

a locking lever engaged to said operating lever;

a connecting link coupled to the operating knob through the pin; and a rotary contact coupled to the connecting link, said rotary contact having a plurality of arms to make and break contact with a plurality of stationary contacts;

wherein said operating knob is moved to displace the connecting link to move the rotary contact to make or break electrical contacts;

wherein the operating lever and the connecting link are coupled to the operating knob through the same pin.

2. The mechanism according to claim 1, wherein the pin is a U-shaped pin.

3. The mechanism according to claim 1, wherein the connecting link is coupled to the rotary contact through a pivot.

4. The mechanism according to claim 1, wherein the operating knob is moved between ON and OFF positions.

5. The mechanism according to claim 1, wherein the locking lever locks or releases the operating lever.

6. The mechanism according to claim 1, wherein the operating knob is moved to displace the rotary contact to enable the arms of said rotary contact to make and brake with stationary electrical contacts.

7. The mechanism according to claim 1, wherein the rotary contact has four arms.

* * * * *